United States Patent [19]

Armstrong

[11] 4,249,449

[45] Feb. 10, 1981

[54] MUSICAL INSTRUMENT

[76] Inventor: Robin E. Armstrong, P.O. Box 5265 Station A, Toronto, Ontario, Canada

[21] Appl. No.: 87,494

[22] Filed: Oct. 23, 1979

[51] Int. Cl.[3] ..... G10D 1/00

[52] U.S. Cl. ..... 84/173; 84/265; 84/285; 84/297 R

[58] Field of Search ..... 84/173, 184–188, 84/197–198, 209, 264–265, 285, 297 R

[56] References Cited

U.S. PATENT DOCUMENTS

| | | | |
|---|---|---|---|
| 783,781 | 2/1905 | Gertz | 84/186 |
| 1,799,696 | 4/1931 | Miller | 84/264 |
| 3,447,411 | 6/1969 | Bloxsom | 84/264 |

FOREIGN PATENT DOCUMENTS

| | | | |
|---|---|---|---|
| 2442586 | 3/1976 | Fed. Rep. of Germany | 84/173 |

*Primary Examiner*—Lawrence R. Franklin
*Attorney, Agent, or Firm*—Sim & McBurney

[57] ABSTRACT

There is provided a stringed instrument in which an outer peripheral frame surrounds an open area, and in which a sounding board extends across the open area attached to the frame. Anchoring means for strings are centrally located in the open area, and pegs are distributed around the edge of the frame. Strings are provided between the anchoring means and the pegs, and due to the symmetrical nature of the structure, the high tension forces exerted by the strings on the center anchoring means are largely balanced out, so that particularly heavy bracing structure for the anchoring means is not required. The instrument is suitable for being played by a plurality of players, approaching the instrument from several directions, this being a departure from typical stringed instruments which are designed to be played only by one person at a time.

9 Claims, 2 Drawing Figures

MUSICAL INSTRUMENT

Figure 1:
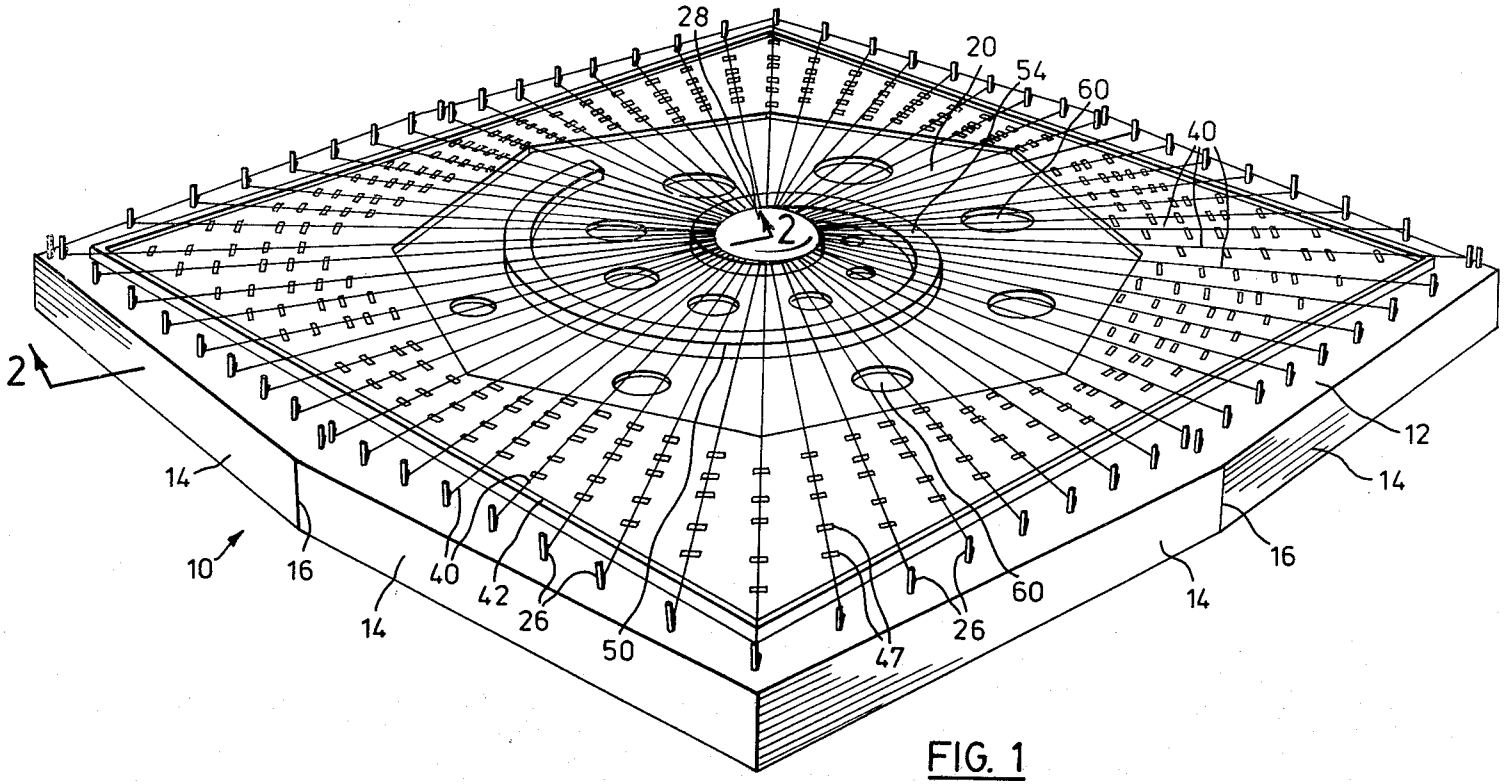

This invention relates to stringed instruments, and has to do particularly with a stringed musical instrument capable of being played simultaneously by a number of players.

Heretofore, musical instruments have been generally designed for being played by a single performer. The violin, the guitar and the harp are thus specifically designed to be played by a single person. It is possible for a piano to be played by more than one person at a time, but the basic design of the piano (an expansion of the clavichord) was not made with plural performers in mind.

One prerequisite for a stringed instrument designed to be played by more than one person at a time, is that adequate access be had to the instrument from a number of different positions, possibly from a number of different sides or angles.

A further factor to be considered relates to the large forces that generated by strings in tension. It is well know, for example, that the combined compressive force exerted on the harp of a piano by all of its strings exceeds several tons. Because of this tremendous force, it is necessary to provide stringed musical instruments with considerable rigidity and stability, so that the compressive force exerted by a tuned string or strings will not cause deformation or rupture of the frame supporting the strings. In many stringed instruments, for example cheaper guitars, it is possible to "untune" one string by tuning adjacent strings higher. The higher tune of the adjacent strings places a greater compression on the neck of the guitar, which causes the upper bridge and the lower bridge to draw together slightly thus "untuning" or lowering the pitch of the previously tuned string.

Thus, in a stringed instrument designed for a number of people to play simultaneously, and thus requiring a large number of strings, the tensile forces of the strings must be counteracted by the structure of the instrument itself. It is an aspect of the present invention to provide a musical instrument structure in which these very great tensile forces are largely balanced out, thus not requiring a particularly heavy or strong construction.

It is a further aspect of this invention to provide a musical stringed instrument which can be played either by the fingers, or by picks, or by hammer-like items, as desired. For this reason, the strings are immediately accessible to the hands of the players, unlike a piano in which keys must be struck.

It is a further aspect of this invention to provide the possibility of "fretting" (i.e. changing the note played by) the strings.

Accordingly, this invention provides a stringed instrument comprising:

an outer peripheral frame means defining a closed loop surrounding an open area, said frame means having a given thickness, an upper surface and a lower surface, a sounding board extending across said open area, a plurality of strings, anchoring means centrally located in said open center, said anchoring means being adapted to receive and anchor one end of each of said plurality of strings, peg means distributed around said peripheral frame means, adapted to receive the other ends of the strings, whereby the strings can be tightened and tuned, and whereby the forces exerted by the tightened strings on said anchoring means are substantially balanced, outer bridge means in contact with the strings adjacent the peg means, and inner bridge means in contact with the strings adjacent the anchoring means.

Figure 2:
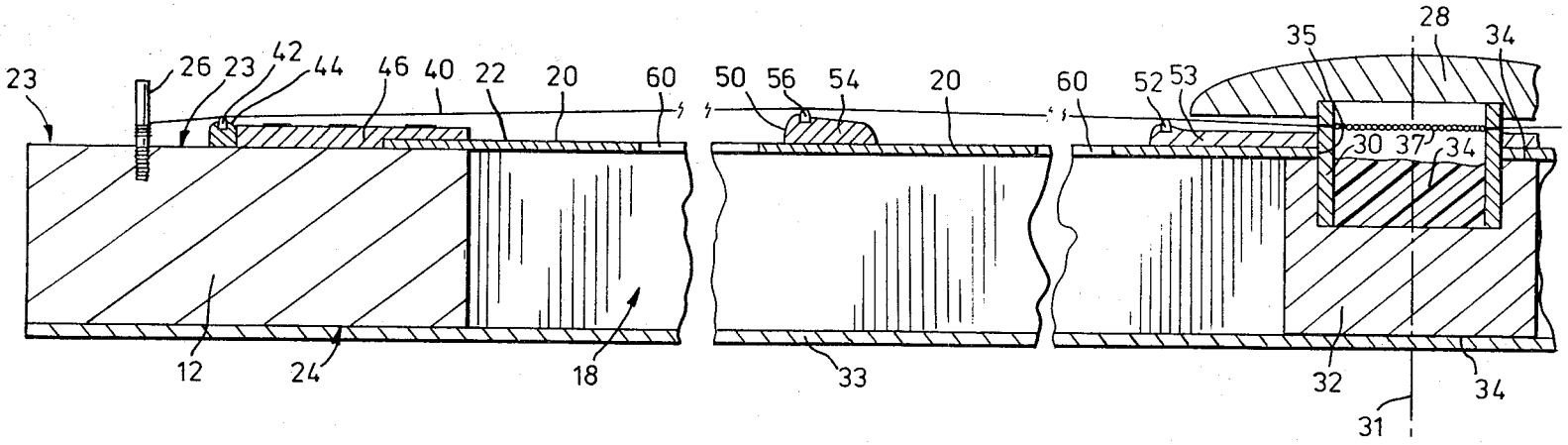

One embodiment of this invention is illustrated in the accompanying drawings, in which like numerals denote like parts throughout the several views, and in which:

FIG. 1 is a perspective view of a stringed instrument constructed in accordance with this invention; and FIG. 2 is a sectional view taken at the line 2—2 in FIG. 1.

In FIG. 1 there is shown at 10 a stringed instrument which includes an outer peripheral frame 12 which defines a closed loop. the instrument shown at FIG. 1 is basically a four sided or square structure, although the individual walls of the square are each made up of two facets 14 set at a wide obtuse angle to each other, the apex of the angle being shown at 16. This latter provision is made for aesthetic purposes, and does not enter into the structure of the instrument. The frame 12 surrounds an open area 18 which in the embodiment shown is octagonal in shape. The open area within the closed loop peripheral frame 12 is, in FIG. 1, covered by an upper sounding board 20, which will be described in greater detail subsequently. For the present, it is enough to understand that the outer peripheral frame 12 is a non-cellular (solid) frame having an outer periphery defined by the facets 14, and having an inner periphery which is octagonal and which follows the octagonal periphery of the upper sounding board 20 shown in FIG. 1.

As can be seen in FIG. 2, the upper sounding board 20 is a sheet of wood 22 which extends outwardly to overlap the frame 12. The sheet 22 is tightly secured, as by glue, etc., to the frame 12.

As can be seen in FIG. 2, the frame 12 is of a substantial thinkness and has an upper surface 23 and a lower surface 24.

A plurality of pegs 26 is provided around the periphery of the frame 12, and to the pegs are attached the ends of a plurality of strings, all of which extend inwardly to an anchoring means which in FIG. 1 is hidden by a cover cap 28, the latter being shown in section in FIG. 2 at the right.

The anchoring means is located centrally within the frame 12, and is adapted to receive and anchor one end of each of the plurality of strings provided. More specifically, with reference to FIG. 2, the anchoring means includes a section of pipe 30 of which the axis 31 is perpendicular to the sounding board 20. The pipe 30 is firmly glued within a cylindrical blind bore in a solid cylindrical piece of wood 32, and the latter is in turn firmly glued to a lower sounding board 33 which overlaps and is secured to the bottom surface 24 of the frame 12. The wooden piece 32 is also glued to the upper sounding board 20, and preferably the pipe 30 is partly filled internally with solidified glue-like material 34, such as epoxy. As can be seen in FIG. 2, the section of pipe 30 extends through and above the upper sounding board 20, through an aperture 35 therein. The portion of the section of pipe 30 which extends above the sounding board 20 has a plurality of radial holes 37 in which the ends of the various strings can be anchored. Typically, the guitar strings come with one end attached to a small metallic "knuckle", and this knuckle constitutes a kind of enlargement at one end, the enlargement being too big to pass through the holes 37.

It can be appreciated now that, since the strings are pulling in all directions away from the section of pipe 30, as can be seen in FIG. 1, and since the strings are relatively evenly distributed directionally, a situation is created in which the tension or force exerted on the section of pipe 30 by one string is approximately counterbalanced by the opposite string. This will mean that the section of pipe 30 is approximately in equilibrium with respect to the forces exerted upon it by the strings, which in turn will mean that the securement means, i.e. the glued attachments between the pipe 30, the piece 32 of wood and the two sounding boards, does not have to be as great as if the strings all extended in one direction.

An outer bridge is provided to contact the strings 40 adjacent the pegs 26, the outer bridge being in effect a continuous metallic ridge 42 which is inlaid or inset into a piece of moulding 44 extending around the periphery of a layer 46 of wooden material (for example plywood) which has a square outer periphery, and an octagonal inner periphery, which in effect defines the edges of the sounding board 20 portion of the sheet 22. As seen in FIG. 2, the layer 46 is undercut at its inner edge to accommodate the sounding board 20.

On the layer 46 are located frets 47 for each string, the frets being aligned under the string and separated longitudinally of the string in known fashion.

An inner bridge is also provided, this being constituted by the inner portion of a spiral member 50, the spiral arm of which constitutes an intermediate bridge.

Dealing first with the inner bridge, it can be seen from FIG. 2 that the inner bridge is constituted by a metallic ridge 52 set into a disc-like portion 53 of the spiral member 50. The disc-like portion 53 snugly surrounds the section of pipe 30, and is secured, as by glue or the like to the upper sounding board 20.

The disc-like central portion 53 gradually merges at one point into the spiral arm 54, and the spiral arm also has a metallic ridge 56 set into it, in the same manner as with the other bridges. In FIG. 2 the position of the spiral arm 54 is clearly shown. The spiral arm is glued or otherwise firmly attached with respect to the upper sounding board 20.

In order for the bridge 56 to actually be a bridge for the various strings, it must extend or project above a hypothetical plane which touches the metallic ridges of the inner and outer bridges. This has been illustrated in FIG. 2.

Thus, each string which extends between the outer and inner bridges, and also passes over the intermediate bridge, will have two "playing" portions, which may be of different or of equal lengths, depending upon the point of the spiral arm 54 where the particular string occurs. Most of the strings will be divided into portions of unequal lengths.

As can be seen in FIGS. 1 and 2, the upper sounding board 20 has a plurality of circular openings 60 provided therein, thus allowing access to the resonating cavity under the upper sounding board 20, in known fashion for stringed instruments such as guitars, violins, and the like.

it is pointed out that the essence of this invention, that of providing a multidirectional stringed instrument for playing by a number of persons, while at the same time providing a simplified construction not requiring heavy brace means in order to counteract the tension of the strings, is achieved regardless of the shape of the intermediate bridge, and indeed regardless of whether the intermediate bridge is present or not. The provision of the intermediate bridge merely provides a greater number of string tones without having to add additional strings (and thus create additional compressive force on the frame 12).

The construction of the actual frame 12 may be of solid wood, metal, firmly glued plywood (preferably hardwood plywood), stiff plastic, or any other suitable material having the requisite strength.

It is preferred, as is usual with stringed instruments, that the sounding boards 20 and 33 be of relatively thin layers of wood, for example spruce.

It is also pointed out that the approximate square outline of the instrument as a whole is also not essential to the invention, since the instrument could be made circular in plan, elliptical, rectangular, or any other choice.

Further, the instrument could be constructed for electronic pick-up, in which case the sounding board 20 and the frame 12 could be combined as a single solid wooden piece, somewhat thicker than the board 20, to which the pipe 30 could be secured by suitable means. The remainder of the construction would be as above described.

I claim:

1. A stringed instrument comprising:

an outer peripheral frame means defining a closed loop surrounding an open area, said frame means having a given thickness, an upper surface and a lower surface, a sounding board extending across said open area, a plurality of strings, anchoring means centrally located in said open center, said anchoring means being adapted to receive and anchor one end of each of said plurality of strings, peg means distributed around said peripheral frame means, adapted to receive the other ends of the strings, whereby the strings can be tightened and tuned, and whereby the forces exerted by the tightened strings on said anchoring means are substantially balanced, outer bridge means in contact with the strings adjacent the peg means, and inner bridge means in contact with the strings adjacent the anchoring means.

2. A stringed instrument as claimed in claim 1, in which each bridge means is constituted by a continuous ridge.

3. A stringed instrument as claimed in claim 1, in which said sounding board extends in substantial alignment with said upper surface of the frame means, in which a further sounding board extends in substantial alignment with said lower surface of the frame means, and in which said anchoring means is held in position primarily by said further sounding board.

4. A stringed instrument as claimed in claim 3, in which said anchoring means is a section of a pipe of which the axis is perpendicular to the sounding boards, said pipe being glued to a wooden block member in turn glued to said further sounding board, the section of pipe projecting through and above said first-mentioned sounding board and having a plurality of holes around the rim of the projecting end, into which the plurality of strings are anchored.

5. A stringed instrument as claimed in claim 4, in which there is further provided an intermediate bridge located between the outer bridge means and the inner bridge means, the intermediate bridge having a ridge projecting above a hypothetical plane which touches the ridges of the said outer and inner bridge means.

6. A stringed instrument as claimed in claim 5, in which the intermediate bridge is in the shape of a spiral centered on said anchoring means.

7. A stringed instrument as claimed in claim 1, claim 3 or claim 5, in which the first-mentioned sounding board has openings therein.

8. A stringed instrument as claimed in claim 1, claim 3 or claim 5, in which frets are provided under each string on the said upper surface, adjacent the outer bridge means.

9. A stringed instrument comprising:

a supporting body construction defining a peripheral portion and a central portion, a plurality of strings, anchoring means centrally located in said central portion, said anchoring means being adapted to receive and anchor one end of each of the said plurality of strings, peg means distributed around said peripheral frame means, adapted to receive the other ends of the strings, whereby the strings can be tightened and tuned, and whereby the forces exerted by the tightened strings on said anchoring means are substantially balanced, outer bridge means in contact with the strings adjacent the peg means, and inner bridge means in contact with the strings adjacent the anchoring means.

* * * * *